United States Patent [19]

Kondo

[11] Patent Number: 4,650,455

[45] Date of Patent: Mar. 17, 1987

[54] WEB FOLDING APPARATUS FOR PACKAGING MACHINE

[75] Inventor: Yoshihito Kondo, Naruto, Japan

[73] Assignee: Shikoku Kakooki Co., Ltd., Tokushima, Japan

[21] Appl. No.: 661,990

[22] Filed: Oct. 18, 1984

[30] Foreign Application Priority Data

Oct. 18, 1983 [JP] Japan ..... 58-195099

[51] Int. Cl.[4] ..... B31B 1/36

[52] U.S. Cl. ..... 493/454; 493/424; 493/434; 493/436; 493/442; 493/443; 493/456; 493/478; 493/473; 493/403

[58] Field of Search ..... 493/405, 416, 417, 422, 493/424, 425, 434, 436, 442, 443, 178, 454, 455, 456, 468, 430, 478, 479, 473, 476, 475, 161, 60, 355, 401, 402, 403; 83/564, 479; 226/175, 177, 165; 29/110, 121.1, 121.8

[56] References Cited

U.S. PATENT DOCUMENTS

| | | | |
|---|---|---|---|
| 659,246 | 10/1900 | Mayall | 493/403 |
| 1,823,475 | 9/1931 | Scudds | 493/402 |
| 3,037,432 | 6/1962 | Gibbon | 493/456 |
| 3,456,565 | 7/1969 | Flaum et al. | 493/473 |
| 3,489,043 | 1/1970 | Dent | 493/60 |
| 4,503,739 | 3/1985 | Konieczka | 85/479 |

FOREIGN PATENT DOCUMENTS 0005130 10/1979 European Pat. Off. ..... 83/479

*Primary Examiner*—R. L. Spruill
*Assistant Examiner*—David B. Jones
*Attorney, Agent, or Firm*—Armstrong, Nikaido, Marmelstein & Kubovcik

[57] ABSTRACT

In a packaging machine for use with a plurality of webs as a packaging material, each of the webs being formed with fold lines extending widthwise thereof and arranged longitudinally thereof at a spacing corresponding to the height of the finished containers to be eventually formed from the web, the plurality of webs being different in the spacing between the fold lines to form containers of capacities which are variable according to the height, a folding apparatus for forming folds in the web by folding the web along the fold lines, comprising a plurality of folding rollers corresponding to the plurality of webs, each of the folding rollers being movable to and retractable from an operative position in which the folding roller is rotatable by the corresponding web when the web is advanced as passed therearound, each of the folding rollers having edges extending axially thereof and coinciding with the fold lines of the corresponding web.

6 Claims, 5 Drawing Figures

WEB FOLDING APPARATUS FOR PACKAGING MACHINE

The present invention relates to an apparatus for forming folds in a web by folding the web along preformed fold lines, for use in a packaging machine, i.e. a machine which is adapted to form a tube from the web serving as a packaging material, to fill fluid food or the like into the tube and to eventually form the filled tube into a finished container in the form of a box.

Some packaging machines are adapted to form containers of different heights to give varying capacities to the containers. For this purpose, a plurality of webs are prepared which are different in the spacing between fold lines.

An object of the present invention is to provide a web folding apparatus which is usable for different kinds of webs.

Another object of the invention is to provide an apparatus for folding webs smoothly and reliably.

The present invention provides a web folding apparatus for a packaging machine for use with different kinds of webs as a packaging material, each of the webs being formed with fold lines extending widthwise thereof and arranged longitudinally thereof at a spacing corresponding to the height of the finished containers to be eventually formed from the web, the plurality of webs being different in the spacing between the fold lines to form containers of capacities which are variable according to the height. The apparatus, which forms folds in the web by folding the web along the fold lines, comprises a plurality of folding rollers corresponding to the different webs, each of the folding rollers being movable to and retractable from an operative position in which the folding roller is rotatable by the corresponding web when the web is advanced as passed therearound, each of the folding rollers having edges extending axially thereof and coinciding with the fold lines of the corresponding web. Thus, the apparatus is usable for a plurality of kinds of webs.

The invention further provides a web folding apparatus for a packaging machine for use with a web as a packaging material, the web being formed with fold lines extending widthwise thereof and arranged longitudinally thereof in succession at alternating two different spacings. The apparatus, which forms folds in the web by folding the web along the fold lines, comprises a folding roller rotatable by the web when the web is advanced as passed therearound and having two axial edges, the edges being spaced apart circumferentially of the roller by distances equal to the two different spacings, the folding roller having a cross sectional contour which is defined by two bulging curves smoothly interconnecting the two edges. Thus, the apparatus is adapted to fold webs smoothly and reliably.

An embodiment of the invention will be described below with reference to the accompanying drawings for illustrative purposes only.

Figure 1:
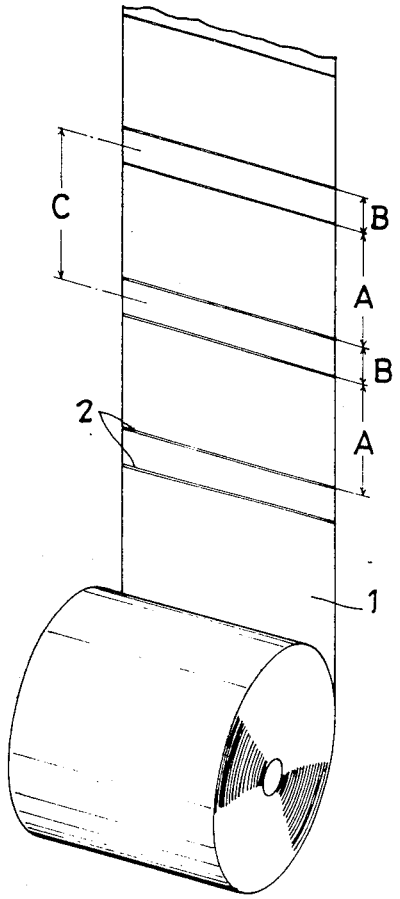
FIG. 1 is a perspective view showing a web serving as a packaging material.
Figure 2:
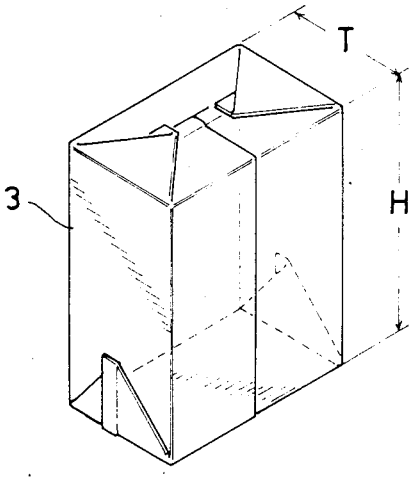
FIG. 2 is a perspective view showing a finished container in the form of a box.

FIG. 1 shows a web 1 which is used as a packaging material for packaging machines. The web 1 is made of paper and has a thermoplastic synthetic resin layer on each side. The web 1 is formed with fold lines 2 extending widthwise thereof and arranged in succession longitudinally thereof at large and small two spacings A and B. The large spacing A corresponds to the height H of a complete container 3 finally formed in the shape of a box and shown in FIG. 2, while the small spacing B corresponds to the thickness T of the container. Thus, one complete container 3 is made from a portion of the web 1 having a length C which portion is composed of a portion having the dimension A (large spacing) and portions extending from this portion on opposite sides thereof and each having a half of the dimension B (small spacing).

Containers 3 of different heights H are formed. The different heights H give two capacities of 200 ml and 250 ml. Accordingly two different kinds of webs 1 are prepared which are different in the large spacing A between the fold lines 2.

The web folding apparatus shown is provided with two kinds of rollers, i.e. first and second folding rollers 4 and 5. Each folding roller 4 (5) has two axial edges 6 and 7 (8 and 9). The line-to-line spacing A of one of the two webs is equal to the larger circumferential spacing between the edges 6 and 7 of the first folding roller 4. The spacing A of the other web is equal to the larger circumferential spacing between the edges 8 and 9 of the second folding roller 5. Of the two rollers 4 and 6, the first folding roller 4 is in an operative position and has the web 1 reeved therearound. The second folding roller 5 is in a non-operative position above the operative position and has no web reeved therearound. Two guide rollers, namely first and second guide rollers 10 and 11, are disposed with their axes of rotation parallel to each other and parallel to the axes of rotation of the two folding rollers 4 and 5. The guide rollers 10, 11 and the first folding roller 4 in the operative position are located at the vertexes of a triangle. Of the two guide rollers 10 and 11, the first guide roller 10 is located immediately above the operative and non-operative positions. The second guide roller 11 is positioned on the left side of, and slightly below, the first guide roller 10. The first folding roller 4 is provided with a tension roller 12. The second guide roller 11 is provided with a holding roller 13. The tension roller 12 and the holding roller 13 are mounted on the forward ends of arms 14, 15, respectively, which are fixed at their base ends to horizontal rotary shafts 16, 17, respectively. These arms are pivotally movable about the rotary shafts 16, 17 and are biased by hydraulic cylinders 18, 19 in such a direction that the rollers 12, 13 press the web 1.

The folding rollers 4, 5 are mounted on the forward ends of two arms 21, 22, respectively, which are fixed to a horizontal rotary shaft 20 and arranged radially as spaced apart by an angle of 180 degrees. The rotary shaft 20 transversely extends through the interior of a hollow frame 23 for the apparatus and is supported by the opposed side walls of the frame by bearings 24, etc. One end of the shaft 20 extends outward beyond the hollow frame 23 and is fixedly provided with a rotating handle 25. An inwardly projecting positioning ball 26 is provided at a lengthwise intermediate portion of the arm of the handle 25. The ball 26 is fittable in an unillustrated notch formed in the outer surface of the side wall of the frame 23 opposed thereo, whereby either one of the folding rollers 4, 5 is positioned in the operative position.

A web positioning rod 27 is disposed in alignment with the axis of rotation of the first folding roller 4 in the operative position. The positioning rod 27 extends through the other side wall of the frame 23 and is axially rotatably supported by a tubular member 28 attached to the wall. A knob 29 is attached to the projecting end of the rod 27. A coiled compression spring 30 is provided between the knob 29 and the tubular member 28 for biasing the rod 27 in a direction to project from the frame 23 at all times. Although not shown in detail, the other end of the positioning rod 27 opposed to the first folding roller 4 is disengageably connectable to the roller 4. When the positioning rod 27 is rotated as connected to the roller 4, the the roller 4 rotates with the rod 27. By rotating the folding roller 4 from outside the frame 23, a fold line 2 in the web 1 can be positioned on the edge 6 of the folding roller 4 for the start of operation.

Rotary disks 31, 32 are attached to the folding rollers 4, 5 at one end of each roller for rotation therewith. A slit (not shown) is formed in each of the rotary disks 31, 32. The angle of rotation of each folding roller is detected by a photoelectric tube (not shown) which detects the slit.

Figure 3:
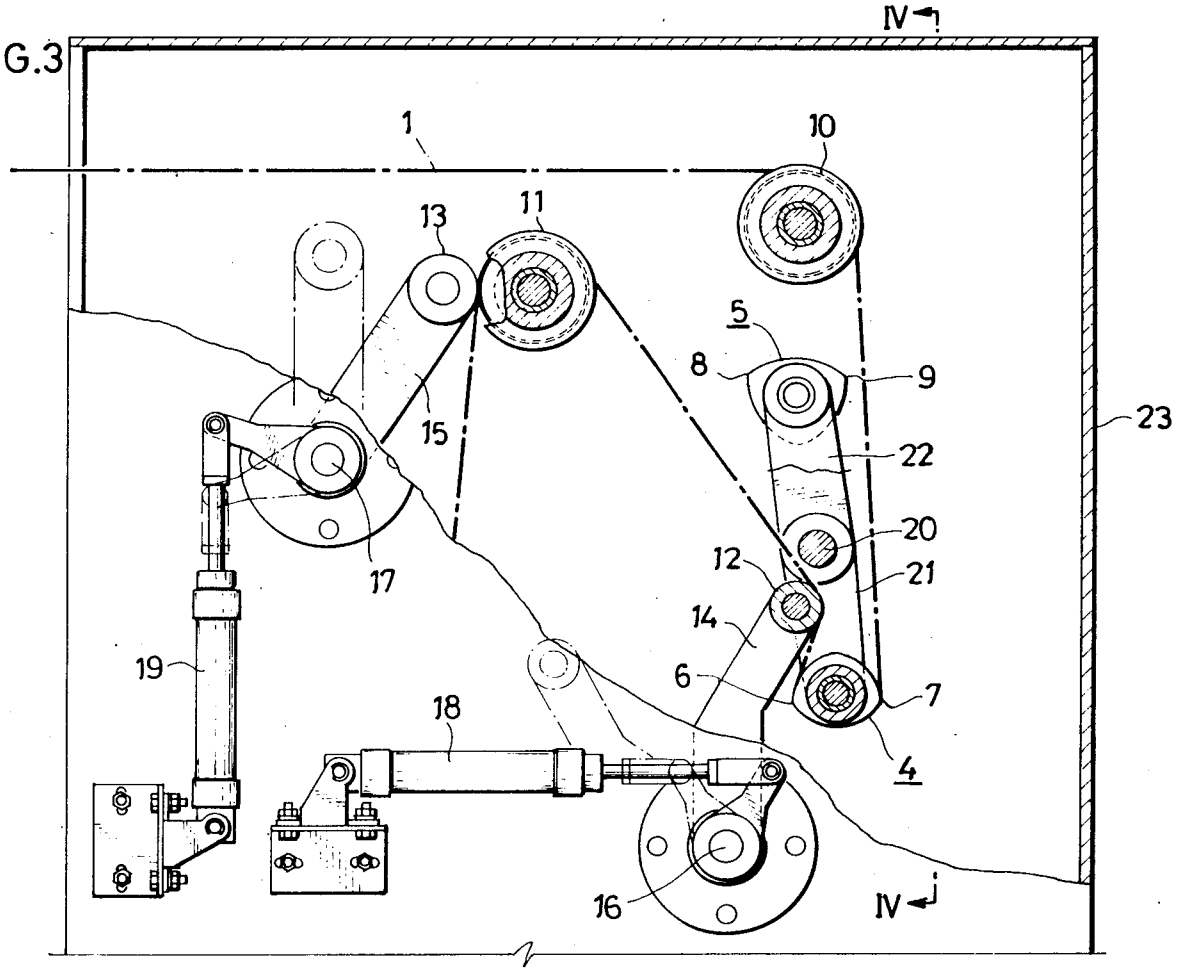
FIG. 3 is a side elevation partly in section and showing a web folding apparatus of the invention.
Figure 4:
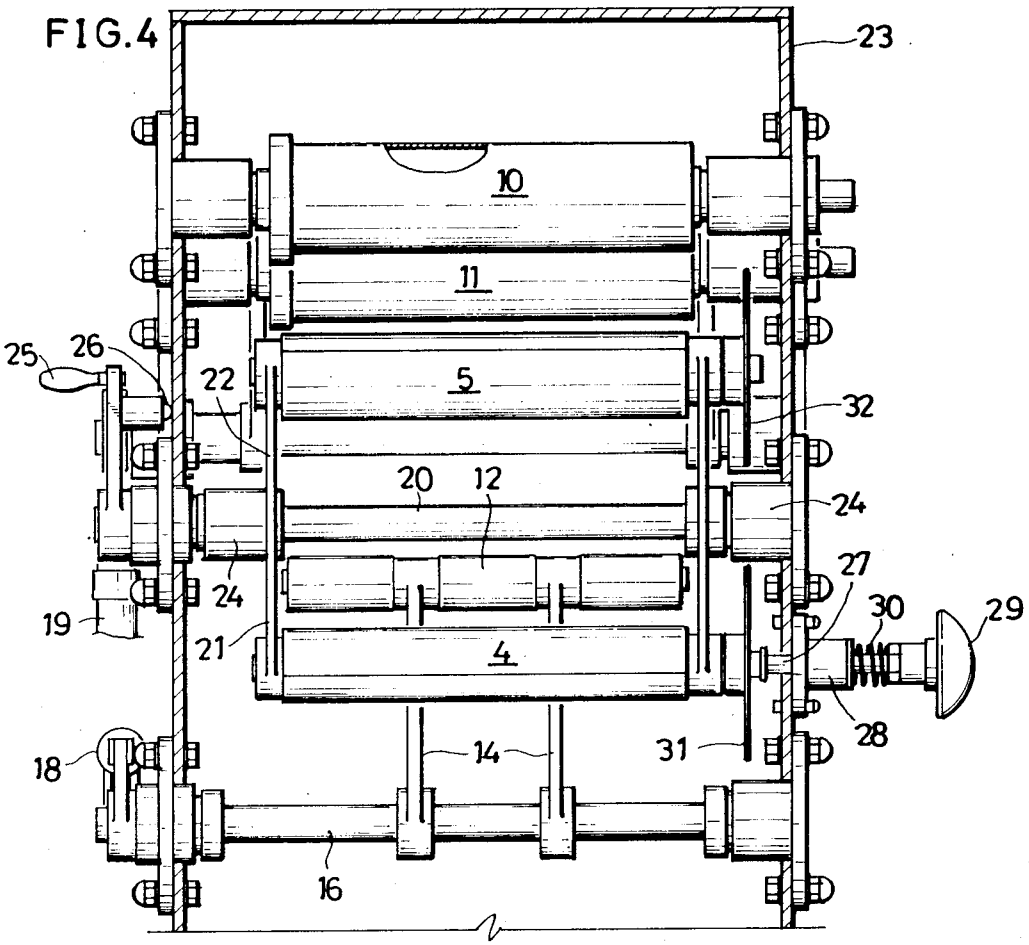
FIG. 4 is a view in section taken along the line IV—IV in FIG. 3.

A web 1, guided forward substantially horizontally from the left of FIG. 3, is passed over the first guide roller 10, then downward and further around the first folding roller 4 in the operative position. The web 1 further extends obliquely rearwardly upward, is passed over the second guide roller 11 and is finally passed downward. While passing between the first folding roller 4 and the second guide roller 11, the web 1 is tensioned by the roller 12. The web is further pressed against the second guide roller 11 by the holding roller 13. The web 1 advances by being pulled downward by unillustrated means. The advancing web 1 rotates the folding roller 4 around which it is passed. When the web 1 passes around the folding roller 4 while rotating the roller 4, the edges 6, 7 of the roller 4 are pressed against the fold lines 2, whereby the web 1 is folded along the fold lines 2.

When the fold line 2 of the web 1 becomes displaced from the edge 6 or 7 of the folding roller 4, the relative position is corrected in the following manner. The angle of rotation of the folding roller 4 is detected by the rotary disk 31, etc. as already stated. The detected angle is compared with the reference angle which does not involve such a displacement, and the feed speed of the web 1 is adjusted by a predetermined amount in accordance with the difference between the two angles.

Figure 5:
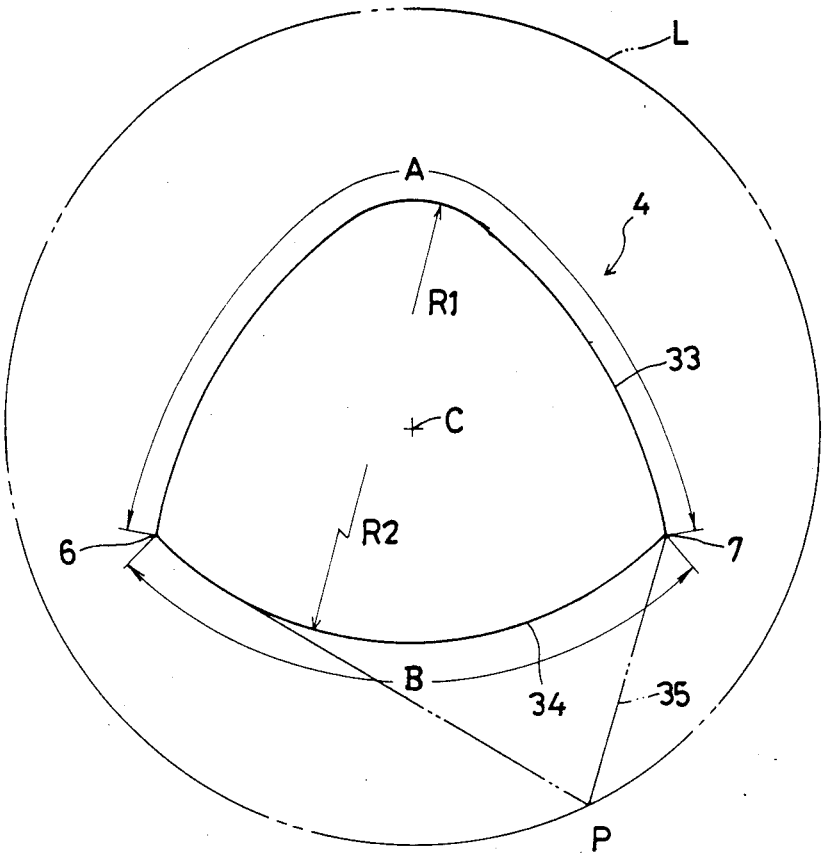
FIG. 5 is a view illustrating the contour of a folding roll in detail.

FIG. 5 shows the cross sectional contour of the folding roller 4 which is typical of the two rollers 4 and 5.

As already stated, the large and small spacings between the two edges 6 and 7 are in match with the large and small spacings A and B between the fold lines 2 on the web 1. The two edges 6, 7 are interconnected smoothly by two smooth bulging curves 33, 34. The curves 33, 34 include, each in the lengthwise midportion thereof, circular arcs having large and small radii R1, R2. Opposite ends of the two arcs are smoothly connected to the edges 6, 7 by other circular arcs. Now, an endless thread 35 longer than the entire circumferential length of the folding roller 4 is provided around the roller and then tensioned between the roller 4 and a point P. When the point P is moved around the roller 4, the point P forms a circular locus L. The locus L is approximate to a true circle centered about the center C of rotation of the folding roller 4. This can be realized when the radii R1, R2 of the circular arcs are suitably determined. If the locus L is precisely circular, the speed of feed of the web 1 passed around the roller 4 is constant.

What is claimed is:

1. In a packaging machine for use with a web as a packaging material, the web being formed with fold lines extending widthwise thereof and arranged longitudinally thereof in succession at alternating two different spacing, a folding apparatus for forming folds in the web by folding the web along the fold lines, comprising a frame having opposed side walls mounted at it opposite ends on said side walls and a folding roller rotatable by the web when the web is advanced and passed therearound and having two axial edges, the edges being spaced apart circumferentially of the roller by distances equal to the two different spacings, the folding roller having a cross sectional contour which is defined by two bulging curves of different curvatures smoothly interconnecting the two edges.

2. An apparatus as defined in claim 1 wherein each of the two curves includes, at the lengthwise midportion thereof, a circular arc which is so sized that when an endless thread longer than the entire circumferential length of the folding roller is provided around the folding roller and then tensioned between the folding roller and a point outside the folding roller and the point is moved around the folding roller, the point forms a locus which is approximate to a true circle centered about the center of rotation of the folding roller.

3. In a packaging machine for use with a plurality of webs as a packaging material, each of the webs is formed with fold lines extending widthwise thereof and arranged in succession longitudinally thereof at two alternating spacings corresponding to the height of the finished containers to be eventually formed from the web, the plurality of webs being different in the spacing between the fold lines to form containers of capacities which are variable according to the height, a folding apparatus for forming folds in the web by folding the web along the fold lines, which comprises:

a hollow apparatus frame provided with a pair of opposed side walls into which the webs are introduced, a horizontal rotary shaft supported by said opposite side walls of said frame and which traversely extends across the interior of the apparatus frame and bridges over the side walls, the horizontal rotary shaft having one end projecting outward through one of the opposed side walls, a plurality of folding rollers equal in number to the number of webs, each of the rollers being rotatable about the horizontal rotary shaft and movable to and retractable from an operative position and, when in the operative position, rotatable around a rotary shaft being in parallel with said horizontal rotary shaft, each folding roller having two edges, the two edges being spaced apart from each other circumferentially of the roller by distances equal to the two different spacings of one web, each roller having a cross sectional contour defined by two bulging curves of different curvatures smoothly interconnecting said two edges, two guide rollers supported by said opposite side walls of said frame each of said guide rollers having a rotary shaft parallel to said horizontal rotary shaft and being arranged at the vertexes of a triangle with one of the folding rollers in the operative position, and a rotating handle fixed to said outwardly extending end of the horizontal rotary shaft for selectively moving one of the folding rollers on said rotary shaft into operative position.

4. An apparatus as defined in claim 3 wherein each of the two curves includes, at the lengthwise midportion thereof, a circular arc which is so sized that when a thread longer than the entire circumferential length of the folding roller is provided around the folding roller and then tensioned between the folding roller and a point outside the folding roller and the point is moved around the folding roller, the point forms a locus which is approximate to a true circle centered about the center of rotation of the folding roller.

5. An apparatus as defined in claim 3 wherein the rotating handle is provided with an arm extending radially of the horizontal rotary shaft by which arm the locking means is held and with a ball fittable in a notch formed in the outer surface of one side wall of the apparatus frame.

6. An apparatus as defined in claim 3 further including a web positioning rod extending through one of the side walls in alignment with the axis of rotation of a folding roller in the operative position and axially movable and disengageably connectable to said folding roller for rotation therewith.

* * * * *